US007181806B2

(12) United States Patent
Folkmar

(10) Patent No.: US 7,181,806 B2
(45) Date of Patent: Feb. 27, 2007

(54) ADJUSTABLE CLIPS

(76) Inventor: Jan Folkmar, Gotthardstasse 43 P.O. Box 263, Weggis (CH) 6353

( * ) Notice: Subject to any disclaimer, the term of this patent is extended or adjusted under 35 U.S.C. 154(b) by 141 days.

(21) Appl. No.: 10/728,867

(22) Filed: Dec. 8, 2003

(65) Prior Publication Data

US 2005/0120521 A1 Jun. 9, 2005

(51) Int. Cl.
*B65D 77/10* (2006.01)

(52) U.S. Cl. ..... 24/30.5 R; 24/490; 24/518

(58) Field of Classification Search ..... 24/518, 24/517, 490, 543, 30.5 R; 383/68; 606/120, 606/157; D9/434, 443
See application file for complete search history.

(56) References Cited

U.S. PATENT DOCUMENTS 3,040,749 A * 6/1962 Payton ..... 606/120
3,171,184 A * 3/1965 Posse ..... 606/120
3,354,518 A * 11/1967 Hoover ..... 24/134 R
4,847,956 A * 7/1989 Levine ..... 24/30.5 R
5,079,806 A * 1/1992 Allen ..... 24/30.5 R
5,713,108 A * 2/1998 Solomon et al. ..... 24/30.5 R
2002/0133916 A1* 9/2002 Folkmar ..... 24/30.5 R

* cited by examiner

*Primary Examiner*—James R. Brittain

(57) ABSTRACT

A plastic clip comprising two jaws united at one end by a hinge permitting them to swing between open and closed positions. The hinge may suitably be of the box type including a hinge blade associated with one jaw that is mounted between opposed cheeks associated with the other jaw by a hinge pin received in an elongated bearing opening in the cheeks, and along which the pin may travel to adjust the nip of the jaws. A spring latch at the opposite end of the jaws preferably permits a plurality of latching positions so as to permit the nip of the jaws at that end to be varied. The elongated bearing opening may permit the assembly of the jaws even where the box structure is relatively rigid and where the pin is integrally formed with the hinge blade.

21 Claims, 3 Drawing Sheets

Fig. 1
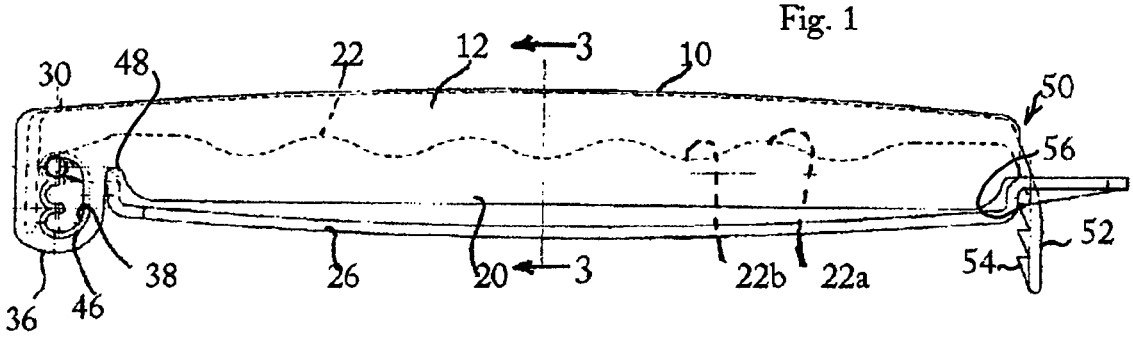
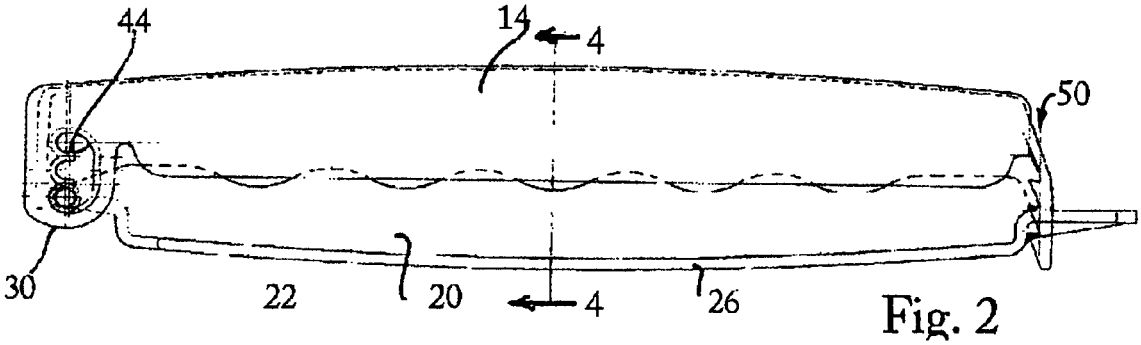
Fig. 2
Fig. 3
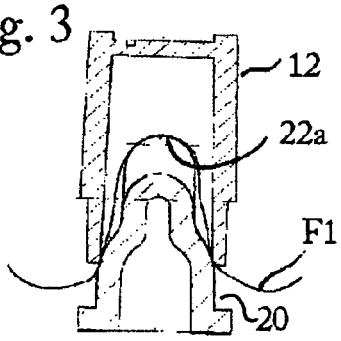
Fig. 4
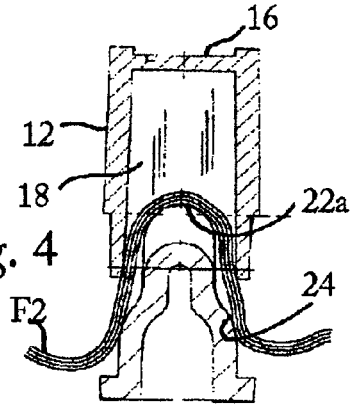

Fig. 6
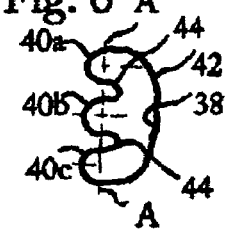
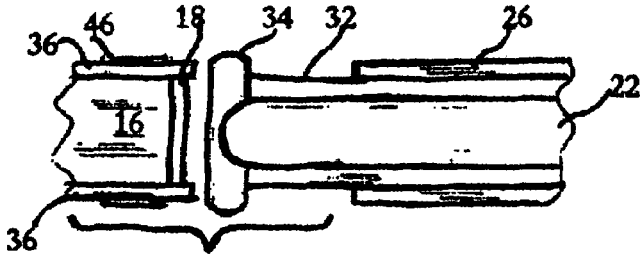
Fig. 5
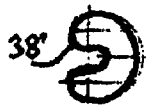
Fig. 7
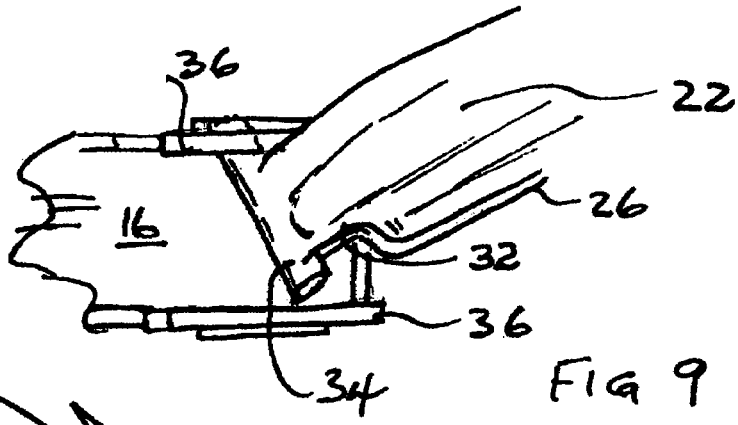
FIG 9
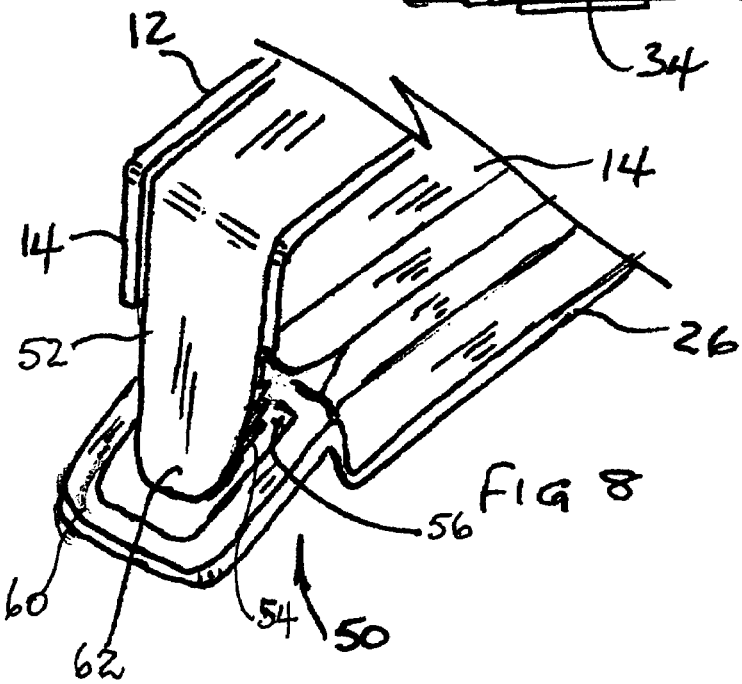
FIG 8

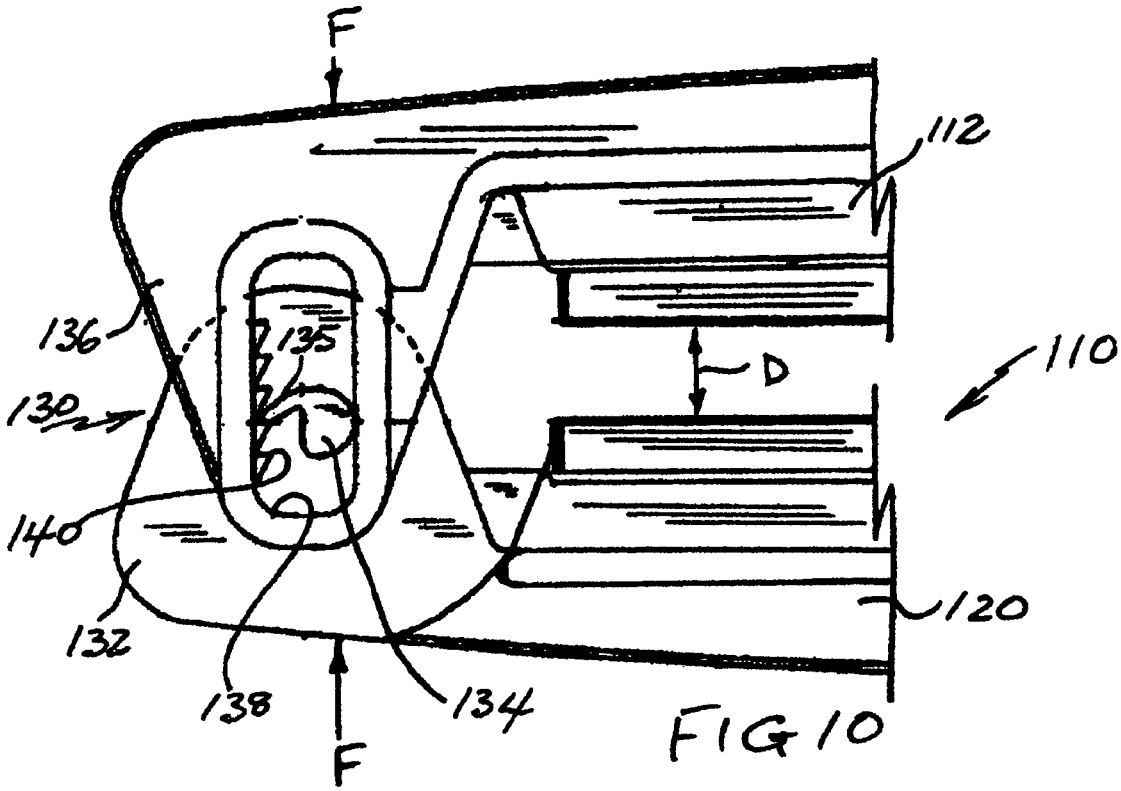
FIG 10
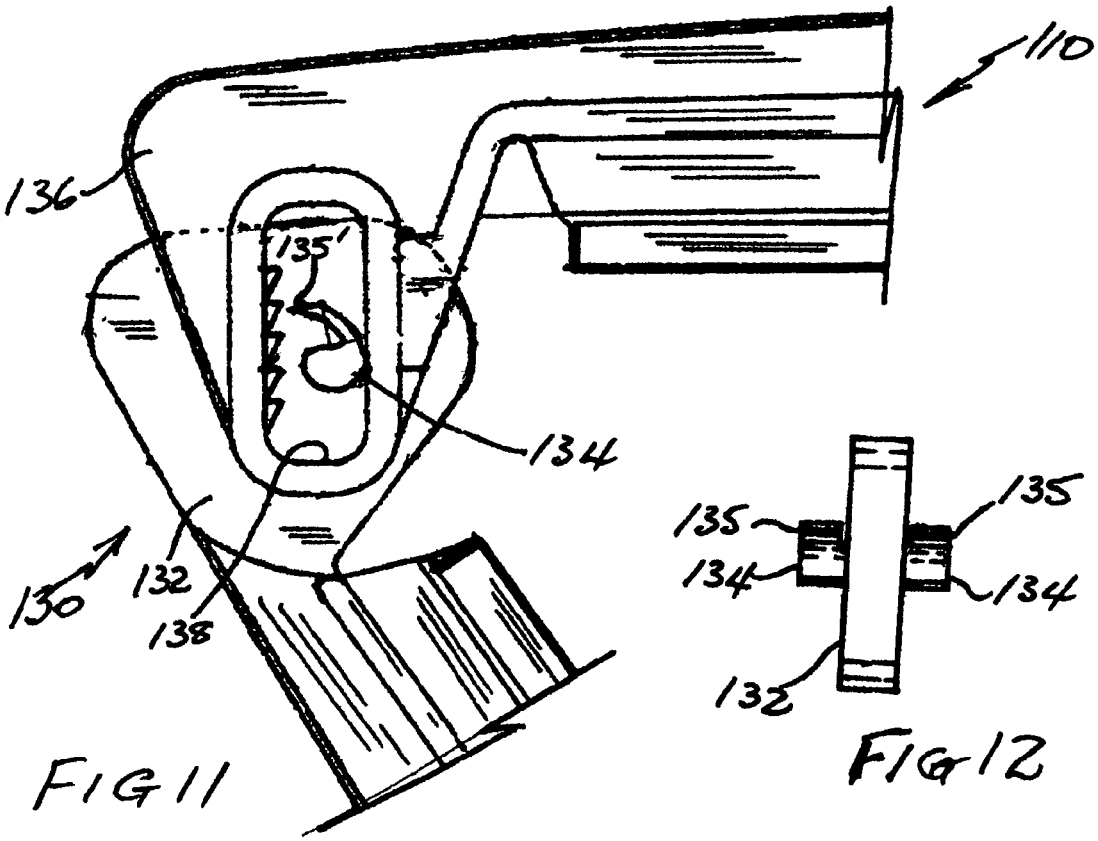
FIG 11
FIG 12

ADJUSTABLE CLIPS

FIELD OF INVENTION

This invention relates to clips, which may be used, for example, to releasably close storage bags.

BACKGROUND OF THE INVENTION

Clips in the general nature of those to which this invention relates are exemplified in patent documents WO 02/076836 and 99/19223, of common inventorship herewith. In general, such clips comprise a pair of axially elongated jaws which are hinged together adjacent one axial end thereof to permit them to swing between a closed position in which the jaws are mutually confronting substantially along their length, and an open position, and a latch disposed adjacent the opposed axial end for releasably retaining the jaws closed about a bag or the like as desired.

The bags with which such clips may find use may vary considerably in their characteristics, for example from thin, single ply polymer film to thick, multi-ply paper. Although clips of several different sizes are available, and a user will normally select a clip having an appropriate size, variations in the bag thickness for any given size of bag are such that they will have a limited range of use.

While bag clips are not normally manufactured to be disposable items, particularly where they are intended for use in larger size bags having a capacity of about 50 kg (about 100 lbs) or more, they are none-the-less required to be inexpensive, and accordingly any improvements should not incur any significant change in cost, thereby effectively precluding highly engineered solutions.

A further problem with bag clips, particularly of the larger sizes, is that the hinge elements are exposed to substantial levering forces, which tend to spring the hinge elements apart where these are of a type using a hinge pin, and skew the jaws.

Known bag clips often use a box hinge comprising three generally orthogonally connected walls forming an axially aligned channel associated with one jaw, having bearing openings in the facing walls of the channel. The other jaw may be provided with a hinge bearing unitarily formed therewith, which snaps into the bearing openings when the channel walls are resiliently deformed. Although this type of hinge is cost effective, it is prone to separating under heavy loads, due either to the use of cup and ball type bearings which engender a wedging apart of the cheeks under the influence of loading forces, or due to the channel walls being too easily deformed in a resilient manner. To overcome these tendencies, hinge pins must be used to the exclusion of cup and ball arrangements, and the channel walls of the hinge may be made substantially more rigid, for example by increasing the thickness thereof, and/or by providing a fourth wall, which interconnects the channel walls substantially along the height of these walls. However, this has heretofore prevented the snap engagement of the fixed hinge pin into the bearing openings, and it has been necessary to use a separately formed hinge pin, thereby increasing manufacturing costs, or to use a hook-together arrangement which reduces the integrity of the hinge.

It is an object of this invention to provide improved bag clips that may more readily accommodate different sizes of bags.

It is another object of this invention to provide bag clips that are economic to produce and easily adjustable.

It is yet another object of this invention to provide adjustable bag clips that are capable of resisting normal forces to which they may be exposed.

It is still another object of this invention to provide bag clips with an economic, two piece hinge structure that is not easily separable under heavy loads.

SUMMARY OF THE INVENTION

In accordance with a broad aspect of this invention, in a bag clip comprising a pair of axially elongated jaws, and hinge means disposed adjacent one axial end thereof about which the jaws are movable between closed and open positions, and latch means adjacent the opposed axial end for releasably retaining the jaws closed, the hinge means and the latch means are each adjustable to permit the spacing between the jaws to be varied, so as to permit the clip to accommodate bags having significantly different thicknesses. Suitably and preferably, the adjustable hinge means and latch means should permit a relatively uniform change in the spacing between the jaws to be achieved, where this is desired.

Also suitably and preferably, the hinge means and the latch means are independently adjustable without necessitating the demounting of the jaws and disassembly of the clip.

In accordance with preferred aspects of the invention, the clip comprises only two parts that may each be molded as unitary items, thereby reducing manufacturing costs.

The adjustable hinge means comprises a pair of transversely spaced apart, axially aligned cheeks associated with one of said jaws; each of the cheeks has a generally vertically oriented elongated opening therein; a hinge pin unitarily formed with the other jaw is slidable along the opening. The opening is provided with a plurality of detents for arresting the sliding movement of the hinge pin, thereby permitting the spacing between the jaws at the hinge end of the clip to be adjusted as desired.

The detents may comprise bearing recesses, each of which communicates with an arcuately formed slot. Where there are two hinge bearing recesses in each cheek, the hinge bearing opening will generally have a cardioid shape, wherein all diametric chords have the same dimension. The hinge pin disposed on the other of the jaws is slidable along the slot so as to be engageable in any desired bearing openings.

The cheeks of the hinge means are in accordance with a first embodiment of the invention united by a top wall and by an end wall, together forming in essence a relatively rigid six-sided box structure that is open in its forward and bottom faces. Notwithstanding the relatively rigid nature of the box portion of the hinge, the elongated nature of the hinge bearing opening permits the snap engagement of the hinge pin within the opening. This is achieved by partially rotating the other jaw about its longitudinal axis so as to cant the hinge pin, and with the jaws of the clip open, engaging the uppermost end of the hinge pin in the opening of one cheek adjacent the upper end thereof. The other jaw is then counter-rotated, forcing the lower end of the hinge pin between the cheeks, until it can commence to enter into the bearing opening. The hinge pin at this point will still be slightly canted, but as it engages fully into the bearing opening of the other cheek, it will assume a horizontal condition, at which time it may be adjusted by sliding along the bearing opening and urged into the bearing recesses of choice.

In accordance with a second embodiment, the detents comprise a gear rack and the hinge pin is provided with a pawl selectively movable between interfering and non-interfering relationship with said rack, to permit the adjustment of the spacing between the jaws of the clip at the hinge end thereof.

Suitably, the adjustable latch means comprises a plurality of ratchet teeth associated with one of the jaws, and at least one ratchet tooth associated with the other jaw. The ratchet teeth associated with one of the one jaw are mounted on a spring finger forming a part of that jaw, so as to be selectively cooperatively engageable with at least one tooth provided on the other of the jaws. It will be understood that the one tooth may be resiliently mounted and the plurality of teeth may be fixed, or that all teeth may be resiliently mounted as may be desired according to particular circumstances.

The above aims, objects and advantages of the invention, together with still further advantages thereof, will become more apparent from a consideration of a preferred, non-limiting embodiment thereof, taken in conjunction with the drawings forming a part hereof

BRIEF DESCRIPTION OF THE DRAWINGS

In the drawings

FIG. 1 shows a clip in accordance with the invention in side elevation, with hidden detail shown in dashed outline, with the clip in a first position of adjustment;

FIG. 2 is similar to FIG. 1 but shows the clip in a second position of adjustment;

FIG. 3 is a cross-section on enlarged scale taken along line 3—3 of FIG. 1, and shows in addition a portion of a bag;

FIG. 4 is similar to FIG. 3, but is taken along line 4—4 of FIG. 2;

FIG. 5 is a fragmentary, exploded plan view of a portion of the hinge detail;

FIG. 6 is a schematic elevational view on enlarged scale of the hinge bearing path;

FIG. 7 is similar to FIG. 6, but shows a hinge bearing path with two bearing openings;

FIG. 8 is a front elevation of the clip of FIG. 1;

FIG. 9 is a fragmentary view of the hinge portion of the clip illustrating the manner in which the jaws of the clip are assembled together;

FIG. 10 is a side elevational view of the hinge end of a clip in accordance with a second embodiment of the invention, with the jaws in confronting position;

FIG. 11 is similar to FIG. 10, but shows the jaws in their open position; and FIG. 12 shows in rear elevation a portion of the hinge of the second embodiment on enlarged scale.

DESCRIPTION OF THE PREFERRED EMBODIMENT

Referring to the drawings in detail, a clip in accordance with a first embodiment of the invention is identified globally therein by the numeral 10. In the ensuing description, the terms upper, lower, forward, rearward and the like are used to facilitate the description of the drawing and are not to be construed as having an absolute meaning unless the context clearly indicates otherwise.

Clip 10 comprises an upper jaw 12, which includes side walls 14 joined along their length by a top wall 16 and at the rearward end by rear wall 18, to provide a relatively stiff, hollow beam structure. Clip 10 further comprises a lower jaw 20 having an upper surface 22 formed with an undulating profile to provide a plurality of crests 22*a* and troughs 22*b* therealong, with side shoulders 24 and a flange 26 extending substantially along the length thereof. As thus far described, clip 10 has elements in common with the clip described in the above referred to WO Patent document 02/076836, the contents of which are incorporated herein by reference thereto as fully as if they were set forth at length herein.

Clip 10 includes a hinge 30 to permit jaws 12 and 20 to move between a closed position, such as is shown in FIG. 1, and an open position (not shown). Hinge 30 includes a hinge blade 32 formed on jaw 20 to project rearwardly from flange 26, and which terminates in a transversely disposed hinge pin 34. Hinge 30 further comprises a pair of cheeks 36, which are spaced apart so as to accept blade 32 snugly therebetween. Each cheek 36 is provided with an elongated bearing opening 38. Each bearing opening 38 has three detent recesses 40*a*, 40*b* and 40*c*, therein which are centered on a notional axis A—A orthogonal to the axis of clip 10, with a cusp 44 between each adjacent pair of recesses. Bearing opening 38 and hinge pin 34 are dimensioned such that the hinge pin is a good fit in the bearing recesses 40*a*, 40*b* and 40*c*, and may be urged under the influence of a small, manually applied force, from one pair of bearing recesses to another pair as desired. Suitably, a small wall 46 circumscribes bearing opening 38 on the outer wall surface of cheeks 36, serving both as a reinforcement and to increase the area of contact between the hinge pin 34 and the bearing recesses. Cheeks 36 are united along their upper end by top wall 16 and adjacent their rearward edge by rear wall 18, which extends substantially along the whole of the height of cheeks 36. The upper portions of the forward edge of cheeks 36 are united with side walls 14 of jaw 12, but the lower portions are spaced apart from side walls 14 by a cut 48. The open box-like structure formed by cheeks 36 and connecting walls 16, 18 provides a relatively rigid structure, and cheeks 36 are not readily forced apart particularly in the vicinity of bearing recesses 40*a*, 40*b* and 40*c*.

Considering now the manner in which jaws 12 and 20 are initially assembled together to form hinge 30, this step is suitably performed when cheeks 36 are warm and susceptible to resilient deformation. The assembly of jaws 12, 20 is effected by rotating the lower jaw 20 slightly about its longitudinal axis, thereby canting hinge pin 34. The uppermost, or leading end of hinge pin 34 is then passed between cheeks 36; in view of the bearing opening 38 having a dimension appreciably greater than the diameter of the hinge pin, this leading end of the hinge pin may be engaged in the bearing opening while subtending a substantial angle to cheek 36, sufficient to permit the trailing end of the hinge pin to pass between cheeks 36 as the lower jaw is counter rotated, without necessitating the application of a destructive force. Continued counter-rotation of the lower jaw 20 ultimately causes the trailing end of hinge pin 34 to snap into position in the bearing opening of the other of the cheeks. Surprisingly, provided that hinge pin 34 is not permitted to cant, it is difficult to disengage the hinge pin, and jaws 12, 20 remain united even under heavy loads.

Clip 10 further comprises a latch 50 at the axial end thereof opposed to hinge 30. Latch 50 comprises a downwardly dependent tongue 52, which is resiliently rooted to jaw 12 adjacent top wall 16 at the forward end thereof, so as to be capable of spring movement. Tongue 52 carries thereon a number of ratchet teeth 54 which are conveniently equal in number and spacing to the number and spacing of the detents provided in bearing opening 38, which is to say in this embodiment bearing recesses 40*a*, 40*b* and 40*c*. A cooperating ratchet tooth 56 is formed on lower jaw 20. Lower jaw 20 at the forward end includes a forwardly projecting frame 60, which serves to locate tongue 52 laterally, and reduce the possibility of the disengagement of latch 50 when under load. Suitably, the width of tongue 50 is progressively diminished on approach to the distal end 62 of the tongue in order to facilitate the entry of the distal end of the tongue into frame 60 as clip 10 is closed when under load.

Considering now the operation of clip 10, when it is intended to use the clip to close a bag constructed of relatively thin material such as uniply film shown schematically in FIG. 3 and identified therein as F1, hinge 30 is adjusted, with the jaws 12, 20 in their open position, so that hinge pin 34 is engaged in the upper ones 40*a* of the bearing recesses. The jaws 12, 20 are then moved towards their closed position causing the ratchet teeth 54, 56 to engage progressively so as to create a uniform gripping pressure on film F1 therealong. Assuming now that it is desired to close a bag with thicker multiply walls such as is identified as F2 in FIG. 4, clip 10 will be adjusted so that hinge pin 34 is engaged in an inferior pair of bearing recesses such as 40*c*. Accordingly, when jaws 12, 20 are moved to their closed position, they will engage to a lesser extent, so as to provide for a suitable clearance for bag wall F2. It will be understood that the ratchet teeth 54, 56 of latch 50 will be engaged appropriately so as to provide a suitable and uniform pressure on bag wall F2.

It will be appreciated that the number of detents in either or both the hinge portion and the latch portion of clip 10 could be varied from that shown, and where for example the clip is intended for use with medium size bags, a bearing opening 38', as shown in FIG. 7, may preferably comprise two bearing recesses and have a cardioid form. Such form may be shaped and constructed wherein all diametric chords have the same dimension, which will be selected to provide a good fit on hinge pin 34 and reduce any tendency of jaws 12, 20 to skew when the jaws are opened and the hinge pin is not seated in bearing recesses.

Considering now a second embodiment of the invention, a clip at the hinge end thereof is identified by the numeral 110. It is to be understood that this clip may suitably be provided with a latch that is generally identical to the latch 50 of the clip 10 of the first embodiment. Clip 110 includes an upper jaw 112 and a lower jaw 120, and a hinge 130 about which the jaws may rotate between open and closed positions. Hinge 130 includes a hinge blade 132 which is associated with jaw 120, from which blade there projects a hinge pin 134 which is conveniently and preferably formed unitarily with the blade. Hinge pin 134 has a finger-like pawl tooth 135, which projects upwardly and rearwardly from the hinge pin.

Hinge 130 further comprises a pair of hinge cheeks 136, which are transversely spaced apart sufficiently to permit the passage of hinge blade 132 therebetween. Cheeks 136 each have a bearing opening 138 therein, which is vertically elongated. Opening 138 has a plurality of detents therein, in the form of a saw-toothed gear rack 140.

The jaws of clip 110 are assembled together in an analogous manner to that in which the jaws of clip 10 are united, which is to say that the lower jaw 120 is partially rotated about its longitudinal axis so as to cant hinge pin 134, and the most upwardly tip of the hinge pin is then engaged in an upper portion of the bearing opening 138 in one cheek 136. Lower jaw 120 is then counter-rotated to force the lower tip of hinge pin 134 between cheeks 136, and ultimately to enter bearing opening 138 in the other of the cheeks.

Bearing opening 138, hinge pin 134 and finger-like pawl 135 are dimensioned such that when jaws 112, 120 are closed, the tip 135' of pawl 135 will be fully engaged with one of the teeth of rack 140, which will prevent the hinge pin from moving downwardly in the bearing opening under the influence of a load applied to jaws 112, 120 when an object is clamped between the jaws. However, should it be desired to decrease the spacing D between the jaws, this is easily effected by applying a compressing force F in the vicinity of hinge 130, as suggested in FIG. 10. Assuming now that it is desired to increase the spacing D between jaws 112, 120, the jaws are moved to their open position; this causes hinge pin 134 to rotate, and to raise pawl 135, whereby ultimately it will not interfere with rack 140, as will be seen in FIG. 12, thereby permitting hinge pin 134 to be lowered to any desired position in bearing opening 138.

The invention claimed is:

1. A clip for releasably closing bags and the like comprising in combination a pair of jaws elongated in an axial direction;

hinge means disposed adjacent one axial end of said jaws to permit relative rotation thereof between an open position and a closed condition wherein said jaws are mutually confronting substantially along their length;

latch means comprising mutually engageable ratchet elements associated with said jaws adjacent the axial end thereof opposed to said hinge means for releasably latching said jaws in their closed position;

said hinge means comprising a hinge pin and bearings therefor associated with said jaws;

said hinge means and said latch means each being adjustable without necessitating the disassembly of said clip so as to permit the clearance between said jaws when in their closed position to be varied;

wherein said adjustable hinge means comprises a pair of transversely spaced apart, axially aligned cheeks associated with one of said jaws, each of said cheeks having a generally vertically oriented elongated opening therein, and a hinge pin slidable within said opening associated with the other of said jaws, and wherein said opening has a plurality of detents associated therewith for arresting the movement of said hinge pin as desired.

2. A clip as defined in claim 1 wherein said detents comprise recesses within which said hinge pin is seatable.

3. A clip as defined in claim 2 wherein the bearing path has a cardioid form wherein all diametric chords are equal.

4. A clip as defined in claim 1 wherein said detents comprise a gear rack and said hinge pin is provided with a pawl selectively movable between interfering and non-interfering relationship with said rack.

5. A clip as defined in claim 4 wherein said pawl is unitarily formed with said hinge pin.

6. A clip as defined in claim 1 wherein said mutually engageable ratchet means comprises a plurality of ratchet teeth associated with one at least of said jaws.

7. A clip as defined in claim 6 wherein said plurality of ratchet teeth is mounted on a flexible finger.

8. A clip as defined in claim 7 wherein the latch means includes a locating frame, and wherein the dimension of said finger on approach to the distal end thereof is diminished to facilitate the entry of the finger into said frame as said jaws are moved from an open position towards a closed position.

9. A clip for releasably closing bags and the like comprising in combination a pair of jaws elongated in an axial direction;

hinge means disposed adjacent one axial end of said jaws to permit relative relation thereof between an open position and a closed condition wherein said jaws are mutually confronting substantially along their length;

wherein said hinge means comprises a pair of opposed cheeks associated with one of said jaws, each said cheek having a bearing opening therein; and a hinge blade associated with the other of said jaws dimensioned to be snugly receivable between said cheeks;

said hinge blade having a generally cylindrical hinge pin formed unitarily therewith to project outwardly therefrom on opposed axially aligned sides thereof engaged in said bearing openings;

wherein said bearing openings are generally elongated orthogonally to said axial direction to permit a sliding movement of said hinge pin therealong, and wherein each said opening is provided with a plurality of detents for arresting said sliding movement as desired; and latch means for releasably retaining said jaws in their closed position comprising mutually engageable ratchet elements associated with said jaws, an least one said element comprising a flexible finger carrying a plurality of ratchet teeth.

10. A clip as defined in claim 9 wherein said bearing openings permit the entry of the hinge pin into the bearing openings when canted.

11. A clip as defined in claim 10 wherein said cheeks form a part of a six-sided box open at two adjacent sides thereof.

12. A clip as defined in claim 9 wherein said detents comprising recesses within which said hinge pin is seatable.

13. A clip as defined in claim 12 wherein the bearing path has a cardioid form wherein all diametric chords are equal.

14. A clip as defined in claim 9 wherein said detents comprise gear rack and said hinge pin is provided with a pawl selectively movable between interfering and non-interfering relationship with said rack.

15. A clip as defined in claim 14 wherein said pawl is unitarily formed with said hinge pin.

16. A clip as defined in claim 9 wherein said latch means includes a locating frame, and wherein the dimension of said finger on approach to the distal end thereof is diminished to ficilitate the entry of the finger into said frame as said jaws are moved from an open position towards a closed position.

17. A clip for releasably closing bags and the like comprising, in combination a pair of jaws elongated in an axial direction;

hinge means disposed adjacent one axial end of said jaws to permit relative rotation thereof between an open position and a closed condition wherein said jaws are mutually confronting substantially along their length;

wherein said hinge means comprises a pair of opposed cheeks associated with one of said jaws, each said cheek having a bearing opening therein; and a hinge blade associated with the other of said jaws dimensioned to be snugly receivable between said cheeks;

said hinge blade having a generally cylindrical hinge pin formed unitarily therewith to project outwardly therefrom on opposed axially aligned sides thereof engaged in said hearing openings;

wherein said hearing openings each form a part of a gear rack elongated in a direction generally orthogonal to said axial direction, and said hinge pin is provided with a pawl selectively movable between a non-interfering position with said gear rack to permit a sliding movement of said hinge pin along said bearing openings and an interfering position arresting said sliding movement.

18. A clip as defined in claim 17 wherein said pawl is unitarily formed with said hinge pin.

19. A clip as defined in claim 17 further comprising latch means for releasably retaining said jaws closed.

20. A clip as defined in claim 19 wherein said latch means includes a plurality of ratchet teeth mounted on a flexible finger associated with one of said jaws.

21. A clip as defined in claim 19 wherein said latch means includes a locating frame, and wherein the dimension of said finger on approach to the distal end thereof is diminished to facilitate the entry of the finger into said frame as said jaws are moved from an open position towards a closed position.

* * * * *